US007246466B2

(12) United States Patent
Turner

(10) Patent No.: US 7,246,466 B2
(45) Date of Patent: Jul. 24, 2007

(54) EXTRUDED PROFILE SYSTEM FOR FORMING SLIDING FENESTRATION PRODUCTS

(75) Inventor: Peter A. Turner, Winnipeg (CA)

(73) Assignee: Hi-Tech Energy Windows Ltd., Winnipeg, Manitoba (CA)

( * ) Notice: Subject to any disclaimer, the term of this patent is extended or adjusted under 35 U.S.C. 154(b) by 398 days.

(21) Appl. No.: 10/895,402

(22) Filed: Jul. 21, 2004

(65) Prior Publication Data

US 2006/0026913 A1 Feb. 9, 2006

(51) Int. Cl.
*E06B 1/04* (2006.01)

(52) U.S. Cl. ..... 49/504; 49/501; 49/DIG. 2; 49/454; 49/456; 49/457; 49/408; 52/204.6; 52/209

(58) Field of Classification Search ..... 49/504, 49/501, DIG. 2, 163, 453, 454, 456, 457, 49/408; 52/204.6, 204.51, 656.5, 209
See application file for complete search history.

(56) References Cited

U.S. PATENT DOCUMENTS 3,555,736 A * 1/1971 Koch ..... 49/504
4,922,661 A * 5/1990 Dallaire et al. ..... 49/504
5,042,199 A 8/1991 Schneider et al.
5,274,955 A * 1/1994 Dallaire et al. ..... 49/406
5,950,398 A * 9/1999 Hubbard ..... 52/786.1
6,067,754 A * 5/2000 Bellart ..... 49/453
6,974,518 B2 * 12/2005 Hornung et al. ..... 156/109

* cited by examiner

*Primary Examiner*—Jerry Redman
(74) *Attorney, Agent, or Firm*—Adrian D. Battison; Michael R. Williams; Ryan W. Dupuis

(57) ABSTRACT

A combination of profiles for forming slider and double hung sash windows or patio doors includes a common outer profile and two different inner profiles so that one inner profile can be used to form the double hung and the other to form the slider. This allows the slider top inner to be cut away to form a floating section resting on the top of the sash. This allows the drain holes to be formed separately in the inner and the outer to be longitudinally offset to prevent direct air penetration. The sash frame is formed with a removable glass stop on one side which snaps into engagement at right angles to the glass surface of the sealed unit to allow formation of a tri-pane with 0.5 inch spacing and to allow the use of two strips of adhesive one on each side of the sealed unit with no need for drainage.

36 Claims, 9 Drawing Sheets

EXTRUDED PROFILE SYSTEM FOR FORMING SLIDING FENESTRATION PRODUCTS

This invention relates to a combination and arrangement of profiles for use in manufacturing sliding fenestration products which may comprise a system for sliding and double hung sash window arrangements or sliding patio doors.

BACKGROUND OF THE INVENTION

The manufacturer of windows and patio doors from extruded vinyl material is well known and has become widely accepted. Vinyl has grown considerably and has a number of advantages over other materials such as wood, metal (primarily aluminium) and glass fiber reinforced materials.

Most commercial window systems at this time require an opening sash section within an outer frame so that the user can open the windows when required. Such windows can include hinges and a pivotal action but these are disadvantageous in that it is necessary for the sash to pivot away from the plane of the main frame leaving it vulnerable to damage and also requiring space either in the interior or the exterior of the building to receive the pivoted sash section.

It is desirable therefore to manufacture windows where there is an outer frame within with the sash section are mounted for sliding movement since these sliding windows are therefore protected within the out main frame and do not take up any additional space in the sliding action since one merely slides in front of the other. Both sections can slide or one section may be stationary and one or more other sections slide relative to the stationary section.

Each sliding windows can be mounted for vertical sliding movement in which case the windows are known as "Double-hung" sash windows in that both sliding sections can slide vertically within the frame in the control of a spring mechanism mounted in the outer main frame which resists the sliding movement to hold the sash at a selected position within the outer frame.

Alternatively the sash windows can be of the horizontal sliding type where the sash windows slide along receptacles defined by the outer main frame. The outer main frame requires less structural elements since it is not necessary to receive any support components for the sash windows since they merely rest in the bottom track or receptacle for horizontal sliding movement to a required position.

Many manufacturers thus provide both a vertical sliding system and a horizontal sliding system manufactured as a system where the structure of the sash frame is a common component to both systems since it requires to support the glass and at the same time simply to slide in the tracks defined by the vertical or horizontal sliding outer frame structure.

Manufacturers therefore often attempt to manufacture this system using a minimum number of separate extruded profiles so as to minimize the complexity of the system, minimize inventory and minimize the amount of tooling necessary for the individual parts.

One example of a double-hung vertical sliding system is shown in U.S. Pat. No. 5,042,199 by the present inventor assigned to Rehau Ag and issued Aug. 27, 1991.

It is commonly known to provide additional profile elements which can snap into engagement with the main frame construction. Thus for example in FIG. 6 of the above patent, there is shown a main frame component which provides the necessary channels or tracks for sliding the sash windows but his can also co-operate with an additional component which snaps into place over the channel or tracks to provide a sill for the structure at the bottom.

For convenience of description, windows are described herein utilizing the term "inner" or "inwardly" in a direction from the frame toward a center of the window in the window plane. Symmetrically the term "outer" or "outwardly" is used in the opposite direction from the center of the window toward the outer frame. To distinguish from these terms, the terms "inside" and "outside" are used in respect of directions at right angles to the plane of the window toward the inside of the building or toward the outside of the building respectively within which the window is mounted. These terms are used consistently throughout the description and Claims here in so as to assist in distinguishing the various components and their locations relative to one another.

SUMMARY OF THE INVENTION

It is one object of the invention to provide an improved combination of profiles for use in manufacturing frames for sliding windows and doors in component system which has advantages over conventional systems.

According to one aspect of the invention there is provided a combination of profiles for forming window or door constructions comprising:

a common outer profile a first inner profile for cooperation with the outer profile shaped and arranged for forming a double hung sash window;

the first inner profile having an inner section which cooperates with the outer profile in defining a first sash receiving section and a second sash receiving section arranged alongside and to the inside of the first sash receiving section;

the first sash receiving section being arranged to receive in sliding movement therealong an outside one of two sash windows and including a first channel outwardly of the window arranged to receive and contain operating hardware for the window;

the second sash receiving section being arranged to receive in sliding movement therealong an inside one of two sash windows and including a second channel outwardly of the window arranged to receive and contain operating hardware for the window;

a second inner profile for cooperation with the outer profile shaped and arranged for forming a slider window;

the second inner profile having an inner section which cooperates with the outer profile in defining a first sliding sash receiving section and a second sliding sash receiving section arranged alongside and to the inside of the first sliding sash receiving section;

the first sliding sash receiving section being arranged to receive in sliding movement therealong an outside one of two sliding sash windows;

the second sliding sash receiving section being arranged to receive in sliding movement therealong an inside one of the two sliding sash windows;

the common outer profile having an outwardly facing surface for engaging an opening in a wall;

the common outer profile defining an inwardly facing receiving channel shaped to receive and locate an outer section of the first inner profile and to receive and locate an outer section of the second inner profile such that the common outer profile can be used either with the first inner profile to manufacture double hung sash windows or with the second inner profile for manufacturing sliding sash windows.

As defined above, therefore, this system utilizes a three component construction including a outer profile and two separate inner profiles one for use with the vertical double-hung slider system and the other for use with the horizontal slider system. Thus the profile components include three separate profiles rather than the conventional two profiles where one of them is common and the inner parts necessary for the two separate systems are fabricated into the different and separate inner profiles.

Surprisingly this arrangement provides significant advantages of cost and efficiency together advantages of operation as described hereinafter.

Preferably the common outer profile has an inside surface at right angles to the outwardly facing surface and outside surface which is inclined.

Preferably the common outer profile has at side edges of the outwardly facing surface inside and outside slots for receiving inside and outside brickmolds.

Preferably each of the first and second inner profiles includes cooperating elements thereon for cooperating with elements on the common outer profile for location in the inwardly facing channel thereof by snap fastening of the cooperating elements.

Preferably the cooperating elements are arranged to allow engagement of the first and second inner profiles in the common outer profile by longitudinal sliding.

Preferably the receiving channel has inside and outside side walls and wherein the cooperating elements include shoulders projecting from the inside and outside side walls into engagement with the inner profile.

Preferably the receiving channel has an inwardly facing outer base wall and the inner profile includes an outwardly facing outer base wall and wherein the cooperating elements include a projecting bead along one of the outer base walls and a cooperating recess in the other of the outer base walls into which the projecting bead can snap.

Preferably, when used to form a horizontal slider, one part of the second inner profile to be used at the top of the window frame has an outer section removed leaving an inner section which is received in the channel of the outer profile in a floating action in a direction inwardly and outwardly, or upwardly and downwardly when at the top so as to engage an outer or top surface of each of the sliding sash windows.

Preferably the outer surface of the sliding sash window includes at least one weather strip carried thereon for engaging the surface of the inner profile.

Preferably the outer profile includes a wall at right angles to the outer surface of the sash window which carries a weather strip for engaging the inside one of the sash windows and wherein the inner profile includes a wall at right angles to the outer surface of the sash window which carries a weather strip for engaging the outside one of the sash windows.

Preferably the inner profile has at least one inner hole formed therein at a selected position along the length thereof for escape of moisture from an inner part of the inner profile outwardly to the outer profile; wherein the outer profile has an outside facing surface with an outer hole formed therein at a selected position along the length thereof for escape of moisture from the outer profile; and wherein the position of the inner hole is longitudinally offset from the position of the outer hole to prevent direct penetration of air.

Preferably the inner profile has a sloped surface inclined in the direction toward the outside away from the sash window so as to tend to drain moisture outwardly.

Preferably the inner and outer profiles each have a sloped surface inclined in the direction toward the outside away from the sash window so as to tend to drain moisture outwardly, the surfaces lying in contact.

Preferably the inner profile has a plurality of walls extending outwardly from the sash window, each of the walls having a drain hole therethrough.

Preferably the inner profile has at least three drain holes therein at spaced positions therealong, with one at each end and at least one intermediate the ends.

Preferably the above system also includes a sash window for mounting in the frame formed by the combination of profiles comprising:

a sealed window unit defined by a plurality of sheets of glass arranged in parallel coextensive arrangement with spacing strips around the edges thereof and fastening elements around the edges thereof to hold the sheets together and to define four outer peripheral edges of the sealed window unit and first and second exposed sheet surfaces of the sealed window unit;

four frame members connected at corners of the sash window to form a rectangular frame construction, each frame member being formed from an extruded profile;

each frame member comprising a generally rectangular structural portion having an inwardly facing surface for receiving in contact therewith a respective one of the four outer peripheral edges of the sealed window unit, the inwardly facing surface having a width defined between first and second side edges equal to a width of the outer peripheral edge;

each frame member having an integral window stop wall at the first side edge extending at right angles to the inwardly facing surface so as to engage the first exposed surface of the sealed window unit to contain the sealed window unit on the inwardly facing surface;

four separate window stop walls each arranged to be fastened to a respective frame member at the second side edge thereof so as to extend at right angles to the inwardly facing surface so as to engage the second exposed surface of the sealed window unit to contain the sealed window unit on the inwardly facing surface;

each separate window stop wall being connected to its respective frame member by a snap coupling defined by cooperating snap coupling elements on the separate window stop wall and the respective frame member which are shaped and arranged such that the separate window stop wall is engaged to its respective frame member by movement at right angles to the separate window stop wall and parallel to the inwardly facing surface;

a first strip of adhesive sealant material between the first exposed surface and the integral window stop wall;

and a second strip of adhesive sealant material between the second exposed surface and the separate window stop wall.

Preferably first and second strips preclude the requirement for drainage from the frame. The strips can be formed by two sided tape or by an extruded bead of a suitable sealant material.

Preferably the coupling elements comprise a lip on the separate window stop wall and a recess on the frame member outwardly of inwardly facing surface.

Preferably the frame member includes a side wall and an inner support wall parallel to the side wall both arranged at right angles to the inwardly facing surface with the recess having an open mouth at the side wall and a base supported by the inner support wall.

Preferably the separate window stop wall includes a bottom leg substantially parallel to the inwardly facing surface outwardly thereof for extending into the recess.

Preferably the structural portion has three weather strip channels therein arranged with two in an outer wall parallel to the inwardly facing surface and the third in a side wall at right angles to the inwardly facing surface.

Preferably the sealed window unit is defined by three sheets of glass arranged in parallel coextensive arrangement with the spacing strips around the edges thereof defining between each sheet and the next a spacing of at least 0.5 inches.

According to a second aspect of the invention there is provided a combination of window profiles for forming window constructions comprising:

an outer profile an inner profile for cooperation with the outer profile shaped and arranged for forming a slider window;

the inner profile having an inner section which cooperates with the outer profile in defining a first sliding sash receiving section and a second sliding sash receiving section arranged alongside and to the inside of the first sliding sash receiving section;

the first sliding sash receiving section being arranged to receive in sliding movement therealong an outside one of two sliding sash windows;

the second sliding sash receiving section being arranged to receive in sliding movement therealong an inside one of the two sliding sash windows;

the outer profile having an outwardly facing surface for engaging an opening in a wall;

the outer profile defining an inwardly facing receiving channel shaped to receive and locate an outer section of the inner profile;

one part of the inner profile having the outer section removed leaving an inner section which is received in the channel of the outer profile in a floating action in a direction inwardly and outwardly so as to engage an outer surface of each of the sliding sash windows.

According to a third aspect of the invention there is provided a combination of window profiles for forming window constructions comprising:

an outer profile an inner profile for cooperation with the outer profile shaped and arranged for forming a window frame;

the inner profile having an inner section which cooperates with the outer profile in defining a first sash receiving section and a second sash receiving section arranged alongside and to the inside of the first sash receiving section;

the first sash receiving section being arranged to receive in sliding movement therealong an outside one of two sash windows;

the second sash receiving section being arranged to receive in sliding movement therealong an inside one of the two sash windows;

the outer profile having an outwardly facing surface for engaging an opening in a wall;

the outer profile defining an inwardly facing receiving channel shaped to receive and locate an outer section of the inner profile such that when assembled, two pieces of the profiles are arranged with the inner profile inside the outer profile to form one side of a window frame;

the inner profile having at least one inner hole formed therein at a selected position along the length thereof for escape of moisture from an inner part of the inner profile outwardly to the outer profile;

the outer profile having an outside facing surface with an outer hole formed therein at a selected position along the length thereof for escape of moisture from the outer profile;

the position of the inner hole being longitudinally offset from the position of the outer hole to prevent direct penetration of air.

According to a fourth aspect of the invention there is provided a sash window for mounting in an outer window frame comprising:

a sealed window unit defined by a plurality of sheets of glass arranged in parallel coextensive arrangement with spacing strips around the edges thereof and fastening elements around the edges thereof to hold the sheets together and to define four outer peripheral edges of the sealed window unit and first and second exposed sheet surfaces of the sealed window unit;

four frame members connected at corners of the sash window to form a rectangular frame construction, each frame member being formed from an extruded profile;

each frame member comprising a generally rectangular structural portion having an inwardly facing surface for receiving in contact therewith a respective one of the four outer peripheral edges of the sealed window unit, the inwardly facing surface having a width defined between first and second side edges equal to a width of the outer peripheral edge;

each frame member having an integral window stop wall at the first side edge extending at right angles to the inwardly facing surface so as to engage the first exposed surface of the sealed window unit to contain the sealed window unit on the inwardly facing surface;

four separate window stop walls each arranged to be fastened to a respective frame member at the second side edge thereof so as to extend at right angles to the inwardly facing surface so as to engage the second exposed surface of the sealed window unit to contain the sealed window unit on the inwardly facing surface;

each separate window stop wall being connected to its respective frame member by a snap coupling defined by cooperating snap coupling elements on the separate window stop wall and the respective frame member which are shaped and arranged such that the separate window stop wall is engaged to its respective frame member by movement at right angles to the separate window stop wall and parallel to the inwardly facing surface;

a first strip of adhesive sealant material between the first exposed surface and the integral window stop wall;

and a second strip of adhesive sealant material between the second exposed surface and the separate window stop wall.

According to a fifth aspect of the invention there is provided a sash window for mounting in an outer window frame comprising:

a sealed window unit defined by three sheets of glass arranged in parallel coextensive arrangement with spacing strips around the edges thereof defining between each sheet and the next a spacing of at least 0.5 inches and fastening elements around the edges thereof to hold the sheets together and to define four outer peripheral edges of the sealed window unit and first and second exposed sheet surfaces of the sealed window unit;

four frame members connected at corners of the sash window to form a rectangular frame construction, each frame member being formed from an extruded profile;

each frame member comprising a generally rectangular structural portion having an inwardly facing surface for receiving in contact therewith a respective one of the four outer peripheral edges of the sealed window unit, the inwardly facing surface having a width defined between first and second side edges equal to a width of the outer peripheral edge;

each frame member having an integral window stop wall at the first side edge extending at right angles to the inwardly facing surface so as to engage the first exposed surface of the sealed window unit to contain the sealed window unit on the inwardly facing surface;

four separate window stop walls each arranged to be fastened to a respective frame member at the second side edge thereof so as to extend at right angles to the inwardly facing surface so as to engage the second exposed surface of the sealed window unit to contain the sealed window unit on the inwardly facing surface;

each separate window stop wall being connected to its respective frame member by a snap coupling defined by cooperating snap coupling elements on the separate window stop wall and the respective frame member which are shaped and arranged such that the separate window stop wall is engaged to its respective frame member by movement at right angles to the separate window stop wall and parallel to the inwardly facing surface.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 9:
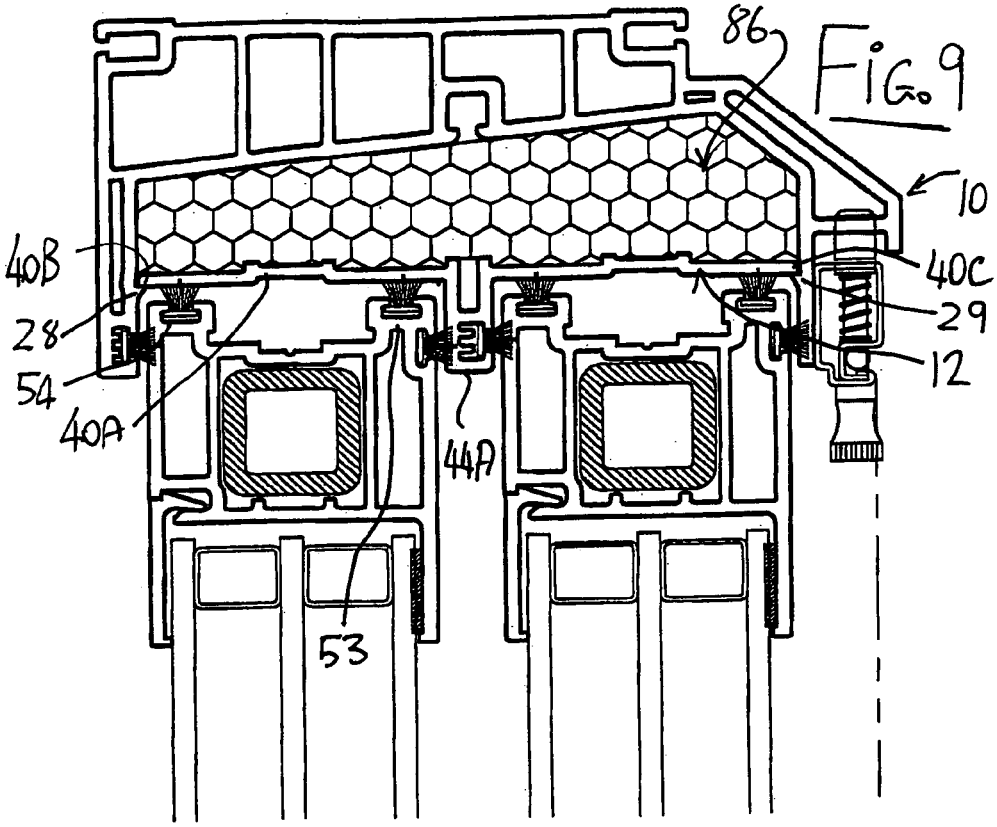
FIG. 9 is a vertical cross sectional view similar to FIG. 8 showing the top or header of the window of FIG. 7.
Figure 10:
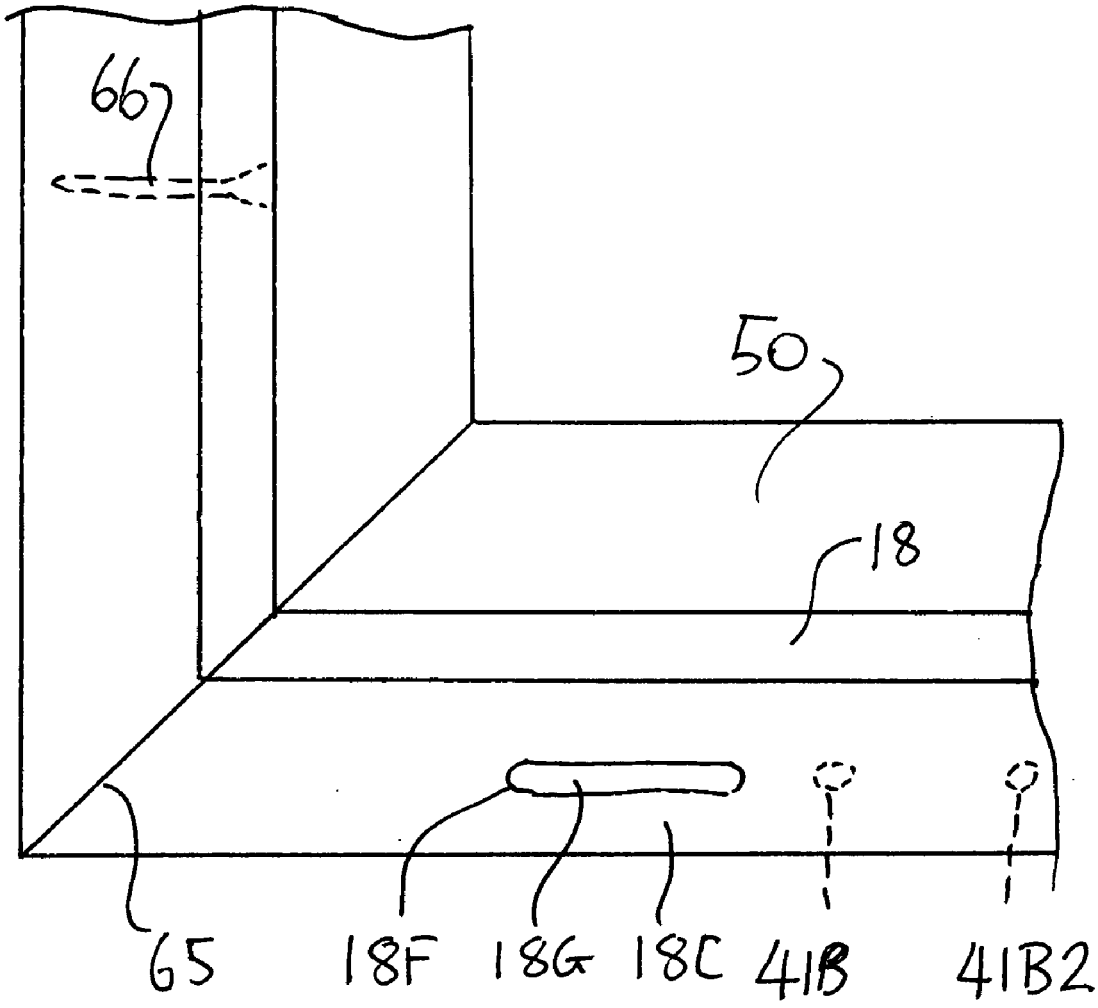
FIG. 10 is a front elevational view of a bottom corner of the sliding sash window of FIGS. 7, 8 and 9.
Figure 11:
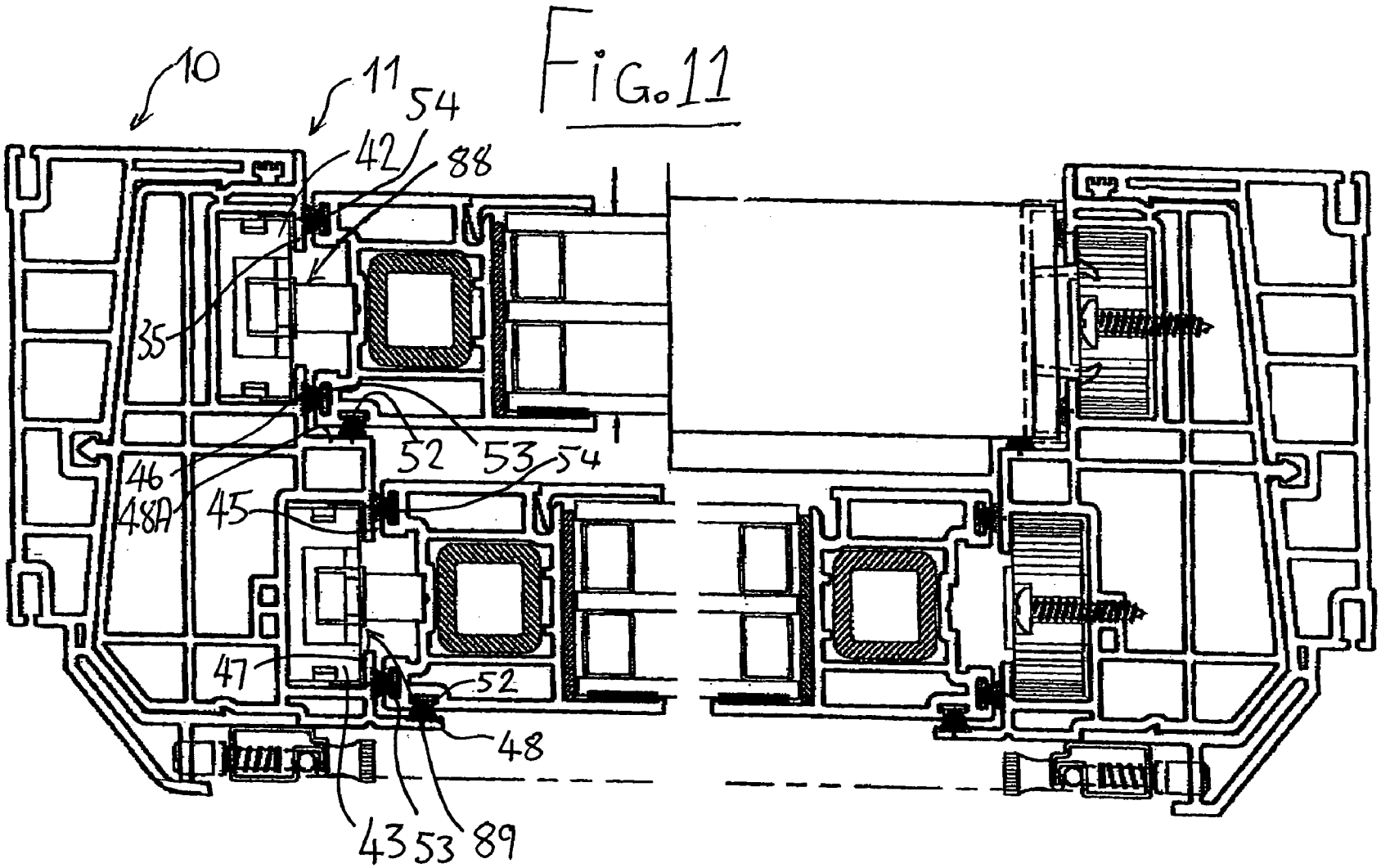
FIG. 11 is a horizontal cross-section through a window utilizing the profiles of the previous figures for use in manufacturing a double-hung vertical sliding sash window.

The system according to the present invention basically comprises five separate components to form the major parts of the two separate window systems defining a horizontal slider as shown in cross-section in FIGS. 7, 8, 9 and 10 and double-hung sash window as shown in cross-section in FIG. 11. The five separate components are shown as the end elevations of the profiles in FIGS. 1 through 5 together with the modified profile shown in FIG. 5A.

Figure 1:
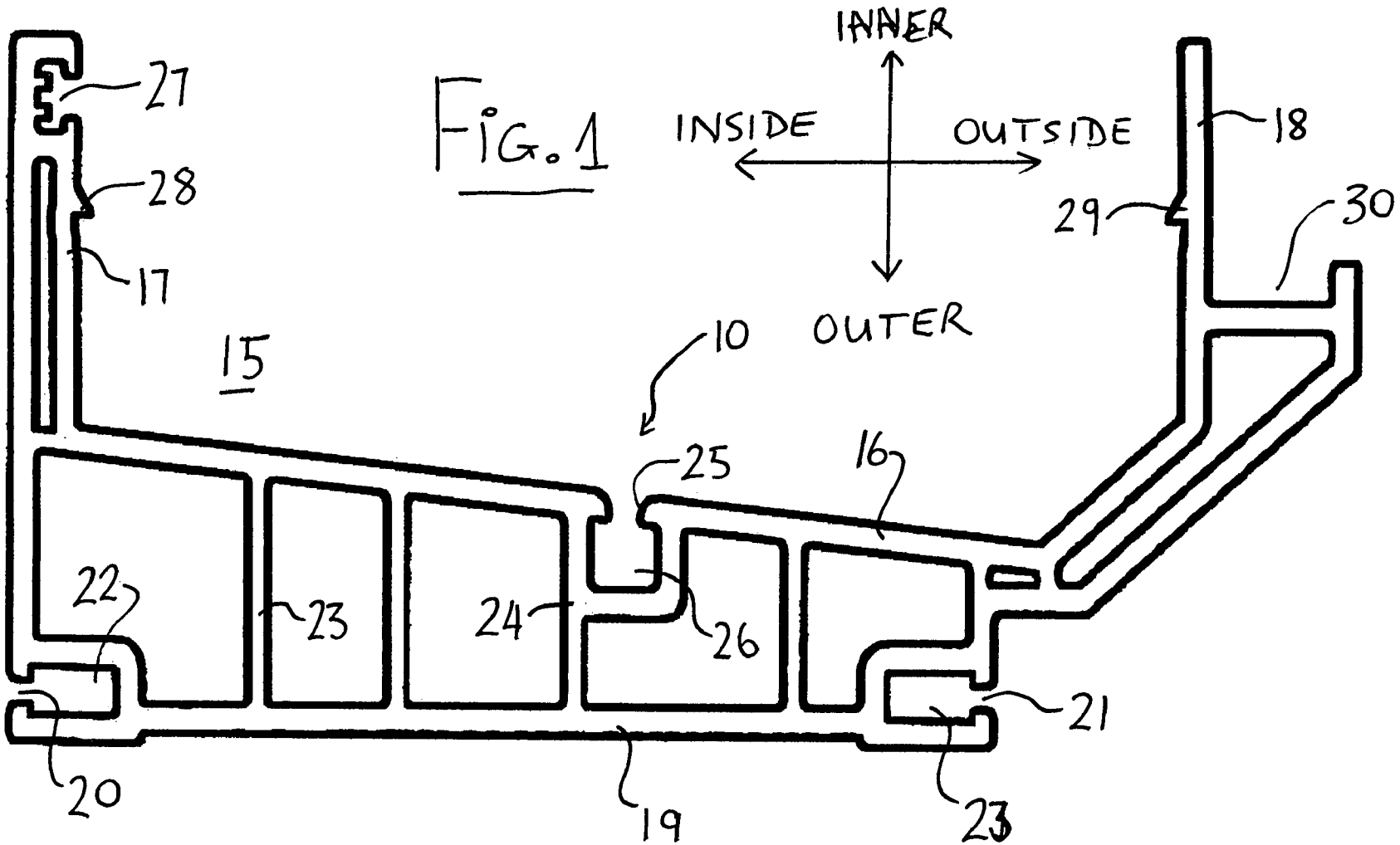
FIG. 1 is an end elevational view of the outer profile of the system according to present invention.

In FIG. 1 is shown the common outer profile indicated generally at 10.

Figure 2:
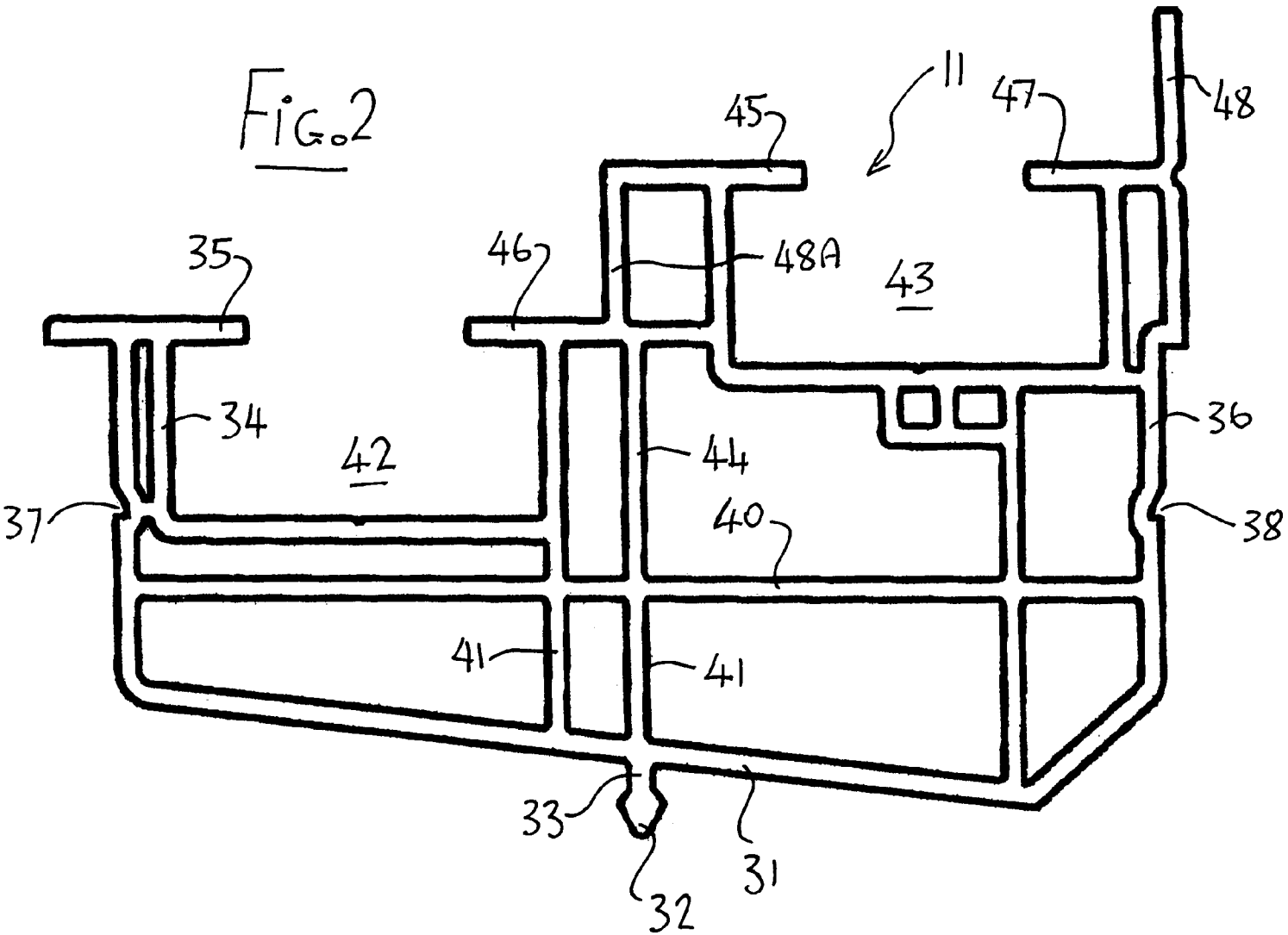
FIG. 2 is an end elevational view of a first inner profile for use in a system according to present invention for manufacturing a vertical double-hung slider system.

In FIG. 2 is shown the first inner profile indicated generally at 11 which provides the necessary structure and support to define the double-hung sash window as described hereinafter.

Figure 3:
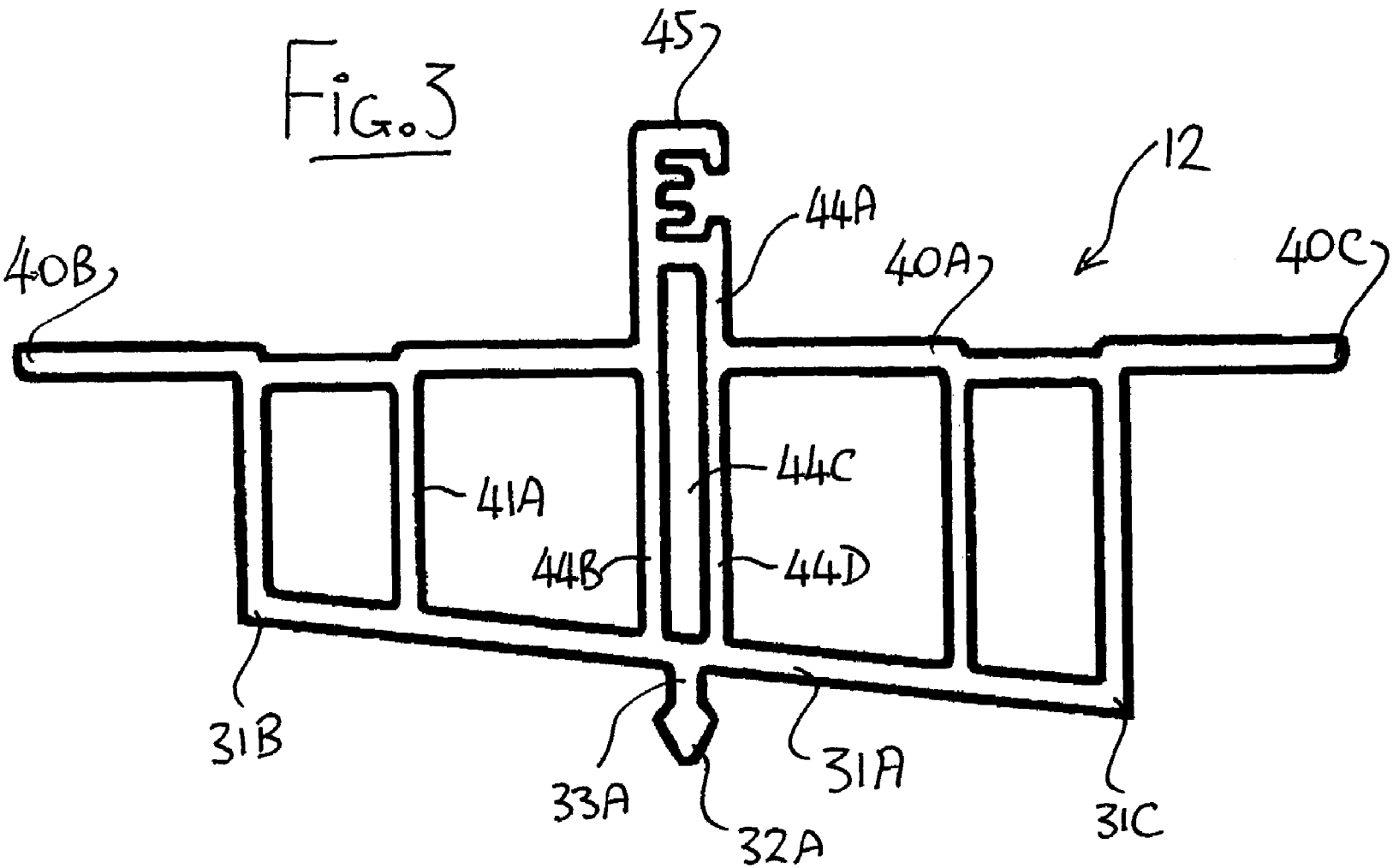
FIG. 3 is an end elevational view of third profile of the system according to the present invention for use in manufacturing a horizontal slider.

In FIG. 3 is shown the second inner profile for forming, in conjunction with the outer profile of FIG. 1, a frame for supporting the horizontal slider sash window as described hereinafter.

Figure 4:
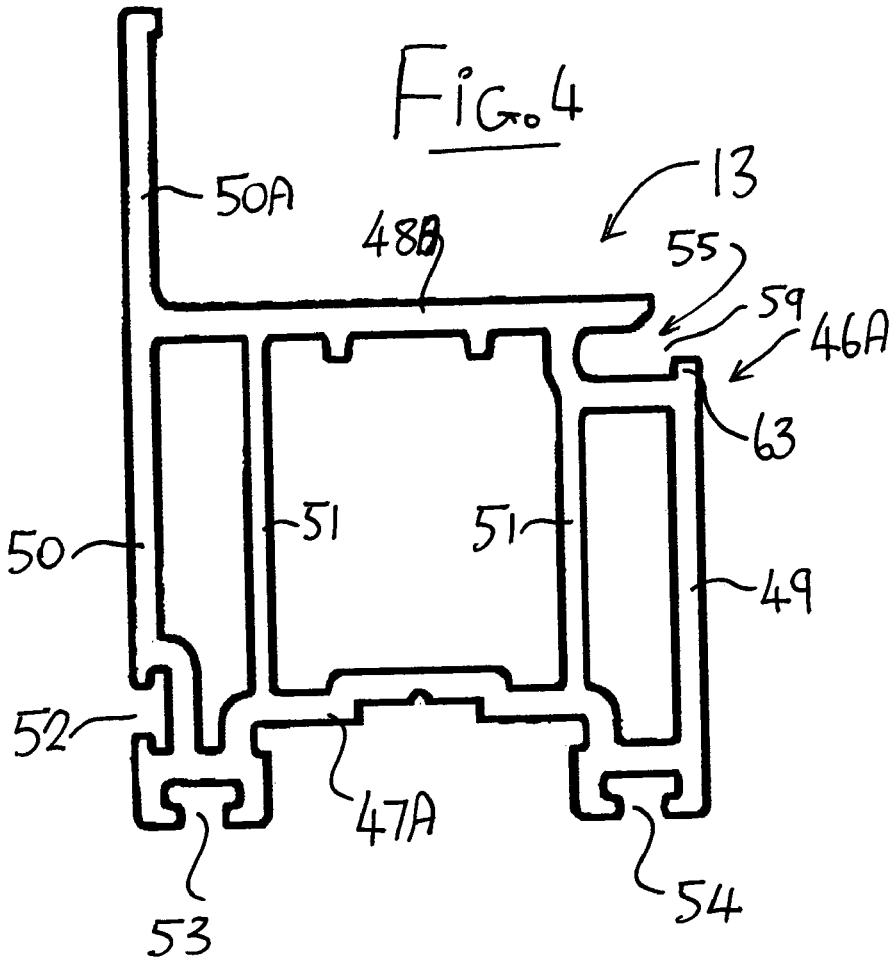
FIG. 4 is an end elevational view of a profile according to present invention for manufacturing the sash frame.
Figure 5:
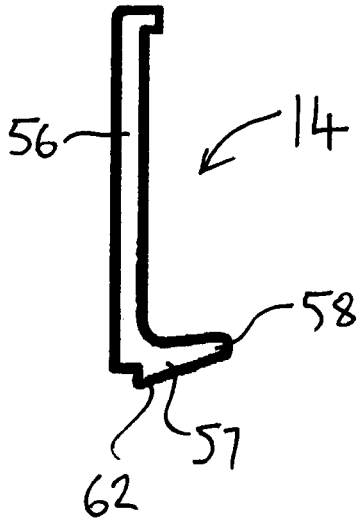
FIG. 5 is an end elevational view of a further profile according to present invention which is a glass stop for use with the sash profile of FIG. 4.
Figure 5A:
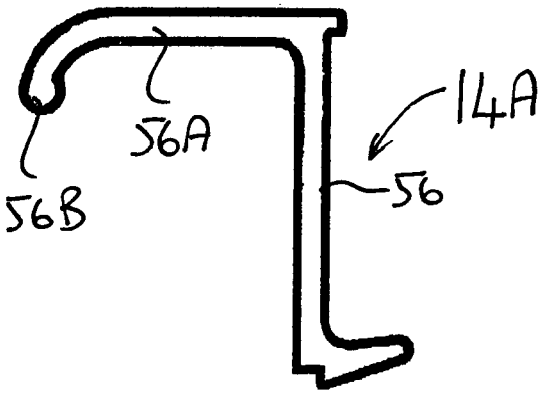
FIG. 5A is a view similar to that of FIG. 5 showing a modified glass stop with handle.

In FIG. 4 is shown the main structure of the sash frame generally indicated at 13 which co-operates with the glass stop 14 shown in FIG. 5 or the modified glass stop with handle as shown in FIG. 5A.

The outer profile 10 shown in FIG. 1 defines a receiving channel 15 having an outer or base wall 16 together with up standing inside wall 17 and up standing outside wall 18. The common outer profile 10 further includes an outer wall 19 which lies at right angles to the inner and outer directions so as to contact a wall of the building at framed opening for receiving the window. The outer wall 19 has at its side edges 20 and 21 respective channels 22 and 22A for receiving brick moulds (not shown) of a conventional nature.

The base wall 16 is inclined at an angle A to the inside/outside direction so that it inclines gradually downwardly toward the outside to act as a drain wall as described hereinafter. The base wall 16 is connected to the outer wall 19 by a plurality of connecting walls 23 which extend in the inner-outer direction. At the center of the base wall 16 is defined a recess 24 with a narrow mouth 25 providing an entry way into a hollow interior 26.

The inside wall 17 is a double wall defined by inside and outside wall members 17A and 17B respectively to provide a stiffened structure. At the top of the inside wall 17 is provided a weather strip channel 27 on the outer surface of the inside wall facing towards the outside of the building so the weather strip inserted into the weather strip channel can engage a sash window described hereinafter. The outside surface of the inside wall 17 includes a shoulder 28 which is generally V-shaped so that is has one surface facing outwardly which is at right angles to the inner/outer direction and another surface facing inwardly which is inclined. In this way the shoulder 28 acts as a snap receptacle so that a co-operating element can slide over the incline surface while moving in the outer direction until it engages over the outer surface where upon it is held against movement in the inner direction.

The outside wall 18 includes an inclined section 18A which connects to the base wall 16 together with a section 18B which lies in the inner/outer direction. The section 18A is supported by an inside support portion 18C which defines an inclined surface 18D which can provide a sill or water shedding surface on the outside of the building. The section 18B is a single wall and carries a shoulder 29 symmetrical to the shoulder 28 at the same height along to outside wall so that the two shoulders 28 and 29 face toward one another into the receiving channel 15. A channel outside the outside wall 18 as a receptacle for a screen frame (not shown).

The first inner profile 11 shown in FIG. 2 has a base wall 31 arranged to match in inclination and width the base wall 16 of the outer profile. The base wall 31 carries a bead 32 on a supporting rib 33 so that the bead projects in the outward direction from the base wall 31. Thus the bead can be inserted into the receptacle 26 through the mouth 25 as a snap fit by forces pushing outwardly on the inner profile to drive the bead into the receptacle 26 through the mouth 25. Alternatively the bead can slide into one end of the receptacle 26 with the rib 33 received in the mouth 25 by relatively sliding movement of the inner and outer profiles.

The inner profile 11 has an inside wall projecting inwardly from the base wall 31 to a top flange 35. The inner profile 11 has an outside wall 36 projecting inwardly form the base wall. The inside wall 34 includes a notch or recess 37 which matches the shoulder 28 on the inside wall of the outer profile 10. Symmetrically there is provided a notch or recess 38 in the outside wall 36 which symmetrically receives and matches the shoulder 29 on the outside wall 18.

Thus it would be appreciated that the inner profile 11 can be inserted into the outer profile 10 either by a snap action forcing the inner profile in the outer direction into the receiving channel so that the shoulders engage into the notches and the bead engages into the receptacle or the same position can be obtained by a sliding action of one profile relative to the other.

When the inner and outer profiles are so assembled, they form an integral structure defining a window frame for receiving the sash windows as described in more detail hereinafter.

It will be appreciated that, when the inner and outer profiles are formed into a frame, the inner and outer profiles when assembled are cut to form a mitre joint at the corners of the frame so that four such frame sections defined by the inner and outer profiles are welded together or bonded together at the corner joint by a mitre joint section. Thus the welding action causes the edges of the top and bottom frame sections to be fastened to edges of the side frame sections to form the rectangular frame structure. This welding action fastens the inner profile and the outer profile at fixed positions relative to one another to form integral structure.

The inner profile 11 includes a transverse wall 40 which is connected to the base wall 31 by a plurality of support walls 41 extending generally at right angles to the transverse wall 40. Inwardly of the transverse wall 40 is defined a first channel 42 adjacent the inside wall 34 and the second channel 43 adjacent the outside wall 36. These channels are separated by center wall portion 44 extending at right angles to the transverse wall 40. The channels 42 and 43 are partly closed by upper flanges 45, 46 and 47 so that the channel 42 is partly closed by the flange 35 at the inner end of the inside wall 34 and by the flange 46. The channel 43 is partly closed by the flange 45 and by a flange 47 at the inner end of the outside wall 36.

The channels 42 and 43 provide receptacles for the operating components of the double-hung sash window as described hereinafter. The flanges 35, 45, 46 and 47 provides supports for the sashes themselves as described hereinafter. The walls supporting the flanges and defining the channels are arranged to provide double thickness where necessary to provide the sufficient strength for the frame structure to carry out its structural requirements thus supporting the sash windows. A stop 48 extends inwardly from the inner end of the wall 36 at the outside end of the flange 47 to provide a stop for the outside one of the two sash windows as described hereinafter. A symmetrical stop 48A is provided for the inside one of the two sash windows.

Turning now to the second inner profile 12 shown in FIG. 3, this is shaped and arranged so as to fit into the common outer profile and particularly within the receiving channel there of. Thus the second inner profile includes a base wall 31A arranged to follow the angle of the base wall 16 of the outer profile 10. However the length of this base wall 31A between an inside edge 31B and an outside edge 31C is shorter than the length of the base wall 16 so that the edge 31C is arranged to fit at the bottom edge of the base wall 16 but the edge 31B is spaced in the outside direction relative to the side wall 17. The second inner profile 12 further includes a transverse wall 40A together with connecting walls 41A extending at right angles to the transverse wall. The transverse wall has end edges 40D and 40C each of which is arranged to engage under the shoulder 28, 29 of the respective side wall 17, 18. The base wall 31A carries a bead 32A mounted on a support rib 33A matching the corresponding components of the first inner profile 11. These components therefore co-operate with the receiving channel 26 and the slot 25 in engagement therewith either by a snap action pressing the second inner profile into the receiving channel of common outer profile in the outer direction or by sliding longitudinally.

The second inner profile includes also an inwardly extending wall section 44, defined by parallel twin walls 44C and 44D providing a space 44B therebetween, located midway between the edges 40B and 40A so as to define with the inside wall 17 a first receiving channel and with the outside wall 18 a second receiving channel. The inwardly extending wall portion 44 includes a weather strip channel 45 which faces toward the outside thus matching the channel 27 of the inside wall 17.

The sash profile 13 shown in FIG. 4 is arranged for co-operation with the glass stops 14 and 14A shown in FIGS. 5 and 5A.

The sash profile 13 includes a structural frame section 46A which is generally rectangular an includes an outer wall 47A, an inner wall 48B, an inside wall 49 and an outside wall 50. These four walls define a generally rectangular structure, the structural strength of the which is increased by supporting walls 51 extending at right angles to the inner and outer walls and parallel to the inside and outside walls. There provided three weather strip channels 52, 53 and 54. The channels 53 and 54 are arranged at the outside and inside edges respectively of the outer wall 47. The channel 52 is arranged in the outside wall 50 adjacent the outer wall 47.

The sash profile 13 further includes a glass stop 50A forming an extension of the outside wall 50 extending above the inner wall 48 to a height to receive a sealed window unit of a conventional construction. The separate glass stop 14 thus is arranged to co-operate with the fixed it integral glass stop 50A to provide the channel for the sealed window unit. The separate glass stop 14 of FIG. 5 snaps into engagement with a channel 55 in the structural portion 46 of the profile 13 at the intersection between the inside wall 49 and the inner wall 48.

Figure 6:
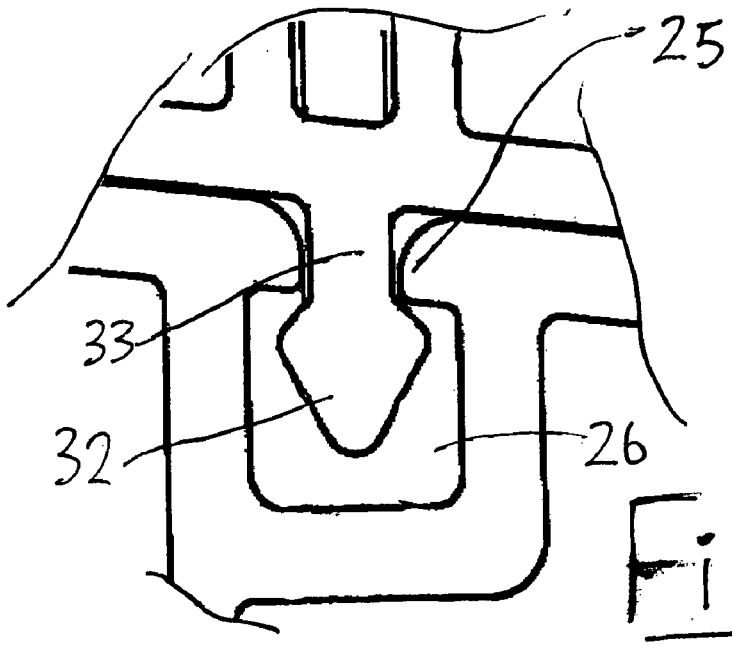
FIG. 6 is enlarged cross sectional view of the snap engagement between one of the inner profiles of FIG. 2 or FIG. 3 with the outer profile of FIG. 1.
Figure 6A:
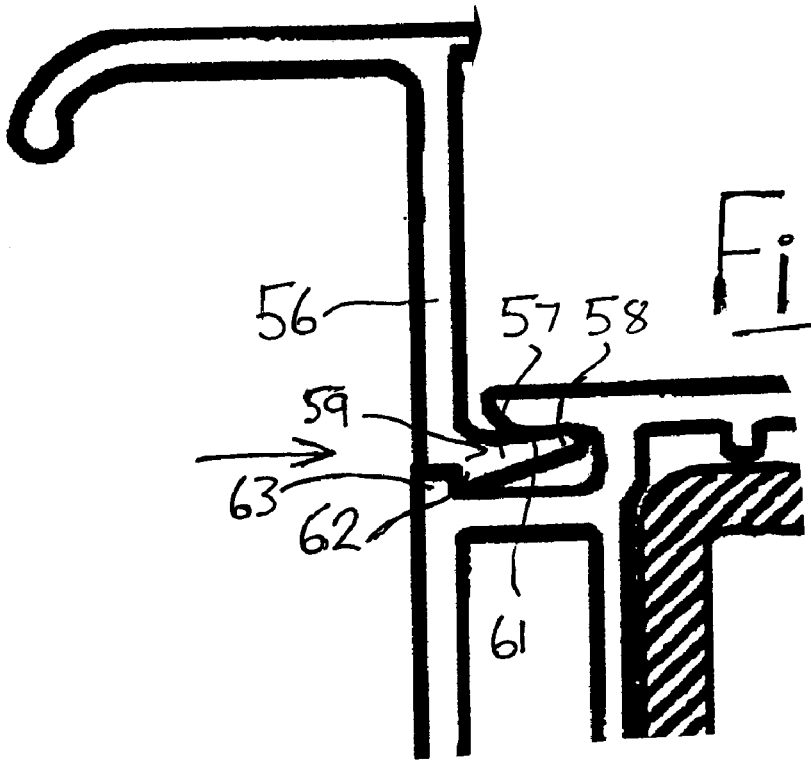
FIG. 6A is enlarged cross sectional view of the snap engagement between the glass stop profile 14 of FIG. 5 and the sash frame 13 of FIG. 4.

This is shown as an enlargement in FIG. 6A, where the separate glass top 14 includes a glass stop wall 56 which, when installed, extends parallel to the fixed glass stopped wall 50A and coplanar with the inside wall 49. The separate glass stop 14 further includes an edge leg 57 which is shaped to engage into the recess 55 as a snap fit. Thus the leg 57 has a tip 58 which is insert through a slot 59 at the mouth if the recess 55. An inner surface 60 of the leg thus slides underneath an outer surface 61 of the inner wall 48 so as to engage against that surface so that the co-plane are surfaces 60 and 61 hold the wall 56 at the required position coplanar with the inside wall 49 and at right angles to the inner wall 48. A shoulder 62 engages over an abutment 63 defining one side of the slot 59 and located at the inner most end of the inside wall 49 which projects into the recess 55.

Thus the leg 57 is inserted by locating the wall 56 parallel to the inside surface of the glass of the sealed window unit and then by moving the wall 56 while remaining parallel to the glass in the outside direction so as to push the leg 57 and its tip 58 into the recess 55 until the shoulder 62 snaps over the abutment 63. This movement is thus wholly in the direction at right angles to the glass surface while the wall 56 remains parallel to the glass surface.

In FIG. 5A is shown a modified glass stop 14 which indicated at 14A and includes at the top of wall 56 an additional lip 56A which acts as a handle extending along the wall 56 for the user to grasp the sash window by pulling on the handle 56A and thus pulling on the sash window in a sliding action. The handle has a looped or curved end at the inside edge as indicated at 56B.

Figure 7:
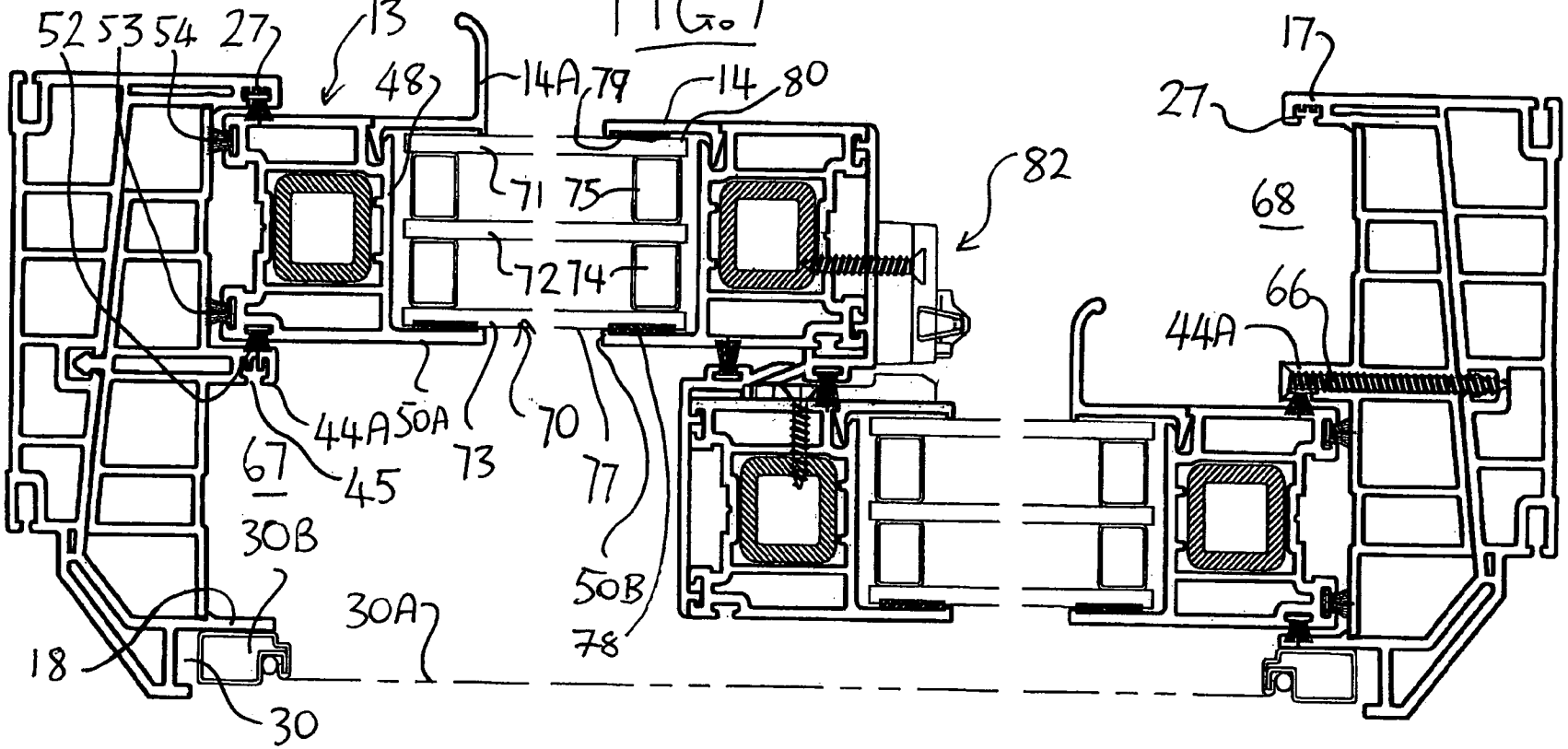
FIG. 7 is a horizontal cross sectional view through a horizontal slider using the profiles of the above figures.
Figure 8:
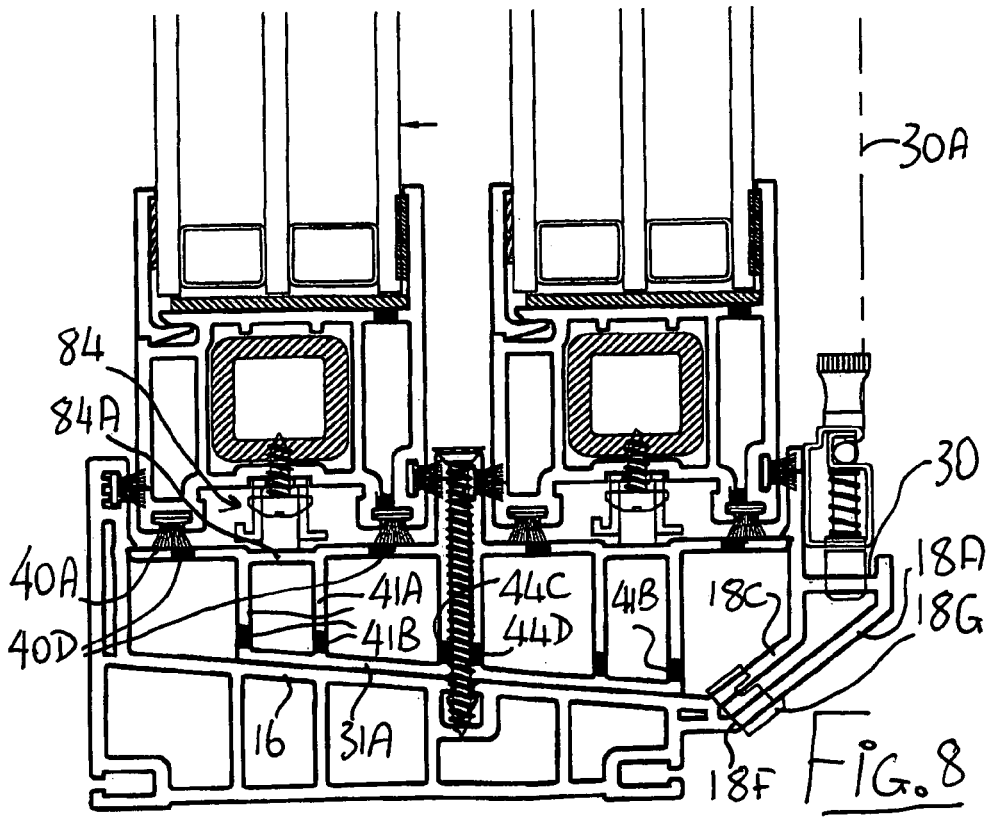
FIG. 8 is a vertical cross sectional view through the bottom of the slider window of FIG. 7.

Turing now to FIGS. 7, 8, 9, there is shown cross sections through the sliding sash window utilizing the common outer profile 10 and the second inner profile 12.

Thus the outer frame defined by the common outer profile 10 and the second inner profile 12 forms a rectangular frame structure, one corner of which is shown in FIG. 10 at which there is provided a welded mitre joint 65. The second inner profile 12 is fastened to the common outer profile 10 by a plurality of screws 66 arranged at spaced positions around the periphery of the outer frame. The screws are insert through the wall 44 of the second inner profile so as to extend through the weather strip channel 45 and through a hollow interior 44B of the wall 44A defined by two parallel side walls 44C and 44D, through the bead 32A and into the base of the channel 26 so as to attach the second inner profile to the common outer profile as both positions around its periphery. The screws thus provide additional structural strength for the outer frame.

Thus when assembled the outer frame defines a first outside slider channel 67 and the second inside slider channel 68. The outside channel 67 is defined by the outside wall 18 and by the wall 44A which carries the weather strip channel 45. The inside channel 68 is defined by the inside wall 17 which carries the weather strip channel 27 and by the inside surface of the wall 44A.

Thus the slider frame defined by the sash frame 13 and the glass stop 14 or the supplemented glass stop 14A as required contains a sealed window unit 70 of a conventional nature.

The sealed window 70 is of a conventional nature defined by three sheets of glass indicated at 71, 72 and 73. The three sheets are separated by two sets of spacers 74 and 75 which are arranged around the edges of the sheets leaving the inner area of the sheets open in conventional manner. Conventional techniques are well known to one skilled in the art for manufacturing such a sealed window unit by which the glass sheets are attached to the spaces and the whole structure is connected together to form a rigid rectangular unit with the edges sealed to prevent penetration of air into the areas between the sheets. Dual pane units can be used including only a single spacer arrangement and two sheets. However it is preferred that a tri-pane construction is formed using three panes with two spacer arrangements. In order to provide a conventionally suitable tri-pane unit, the glass sheets have a thickness of the order ⅜ inch and the spacing between the sheets is at least 0.5 inches leading to a total space between the inside surface of the glass and the outside surface of the glass are at least 2.0 inches. This ensures acceptable levels on insulation. In order to receive such a tri-pane construction within the sash window frame, the inner wall 48 has a width substantially matching the width of the sealed window unit so that when the separate glass stop 14 is inserted into the slot in the structural part 46 of the sash frame 14, the outside surface 77 of the glass butts against the lip 50B at the inner end of the fixed stop 50A clamping, between the outside surface 77 of the glass and the inside surface of the fixed stop, a bead or strip 78 of a sealant material. Symmetrically a second bead or strip 79 of a sealant material is inserted between the moveable stop 14 and the inside surface 80 of the glass.

The bead or strip 78, 79 can be formed as a extruded bead of a sealant which has adhesive properties or can be formed as a strip of double sided tape which acts also as a sealant and a adhesive. The use if such strips of adhesive on both sides of the sealed window unit ensures that both glass surfaces are sealed to the respective surface of the respective stop to prevent any moisture from penetrating along the glass into interior of the frame that is between the sealed window unit and the wall 48. As moisture penetration is prevented, there is no necessity for any drainage action in this area. The avoidance of drainage also of course avoids air penetration so that the sealed window is entirely sealed to its exterior frame to prevent air penetration and moisture penetration.

The ability to use adhesive on both surfaces is obtained form the fact that the movement of the movable stop 14 is directly toward the surface 80 of the glass without any pivoting or sliding action required so it can be moved directly at right angles to the glass while remaining parallel to the glass so it can be pressed against the bead or strip of adhesive which sits on the glass or sits on the inside surface of the stop. In this way the strip or bead can have a highly aggressive adhesive effect since it is not required to shift or adjust in view of the direct right angle movement. The leg 57 can thus simply be tapped into place into its channel squeezing the strip or bead of adhesive to provide the required sealing effect.

The sash frame of the exterior of the structural element 46 is sealed between the outside and the inside by four weather strip elements. Thus there is a weather strip element carried in the channel 27 and the wall 17. Thus there are weather strips carried in the channels 52, 53 and 54 so there is prevented for penetrating from the outside to the inside by each of the four weather strips. Each of the weather strips is of a conventional nature including a central blade or film together with fibrous elements on either side of the central blade. This conventional construction provides an effecting sealing action.

At the center between the two sliding sash windows is provided an interconnection system generally indicated at 82 which is of a conventional nature and provides the sealing elements between the two sash frames and also the locking elements between the two sash frames. As these components are well known to one skilled in the art and do not form part of the present invention, no further detail will be provided herein.

In addition the frame as previously described provides the channel 30 at the outside which receives a bug screen 30A carried in frame members 30B. Yet further the frame members of the sash frame are structurally supported by metal reinforcement members 83 again of a conventional nature.

In FIG. 8 and in FIG. 10 is shown the bottom frame member of the exterior or outer frame within which the sash windows slide. This construction is of the same cross-section as shown in FIG. 7 and described hereinbefore. However the bottom it is necessary to provide drainage for moisture collecting past the weather strips into the bottom track for each of the sliding sashes. Thus as shown in FIG. 8 the wall 40A has a series of holes 40D allowing the moisture to drop downwardly onto the top of the base wall 16 and its adjacent sloped base wall 31A. The base wall 16 and the base 31A thus form a slope surface allowing the water collecting in this area to flow in the outside direction toward the inclined wall 18A. In order to allow water to flow fully in this direction, holes 41B are formed in the walls 41A and in the walls 44C and 44D so as to allow the water to run from each compartment to the next until the water reaches the inclined wall 18A. In the wall 18A and its parallel adjacent 18C is formed a slot shaped opening 18F which is covered by a cap 18G of a conventional nature. Thus all of the moisture entering the final compartment on top of the wall 18A is allowed to escape through the cap at the slot at 18F.

As shown in FIG. 10, the holes 41B are longitudinally offset from the hole or slot 18F. This is obtained by drilling the holes 41B through the walls 41A of the second inner profile while it is separated from the common outer profile and the walls 41A are exposed for simply drilling through each of the hole by a long drill bite. The slot 18F and its cap 18G can be formed separately in the outer profile at the required location so that when assembled the hole 18F is offset from the holes 41B. In this way there is no direct air penetration path and any air entering the system must turn along the channel above the wall 18A and then diffuse through the holes 41B. This reduces air flow and can prevent whistling which can occur when the holes are aligned.

In addition more drainage holes can be provided at a longitudinally spaced positions along the inner profile as indicated at 41B2 so the holes can be provided adjacent the mitre joints and at positions intermediate the ends. Thus for example there may be three drainage holes 41B located one at each end and one 41B2 at the center. These drainage holes can therefore co-operate with a single slot 18F or with slots at each end if required.

Also visible in FIG. 8 is a slide track mechanism generally indicated at 84 which is mounted in the bottom sash frame and rides on a track carried in the slight shallow central recess 84A in the second inner profile.

Turing now to FIG. 9, there is shown the same common outer profile 10 which co-operates with the same second inner profile 12. However this arrangement which is at the top or header of the slide sash window frame, the base wall 31A and the supporting walls 41A, 44C and 44D are all removed. Thus the common inner profile is formed basically by the transverse wall 40A and the center wall 44A. In place of the rigid legs and the base wall, the transverse wall 40A is instead supported relative to the outer profile by a foamed resilient insert 86. Thus the edges 40B and 40C of the wall 40A are held within the common outer profile by the shoulders 28 and 29 but there is no other rigid connection between the truncated second inner profile section and the common outer profile thus by compressing the foamed insert 86 the inner profile can be pushed upwardly for release of the sliders from the bottom. However the compression within the foamed insert 86 presses the wall 40A downwardly onto the weather strips at the top of the slider frame. In this way the four weather strip system can be maintained both at the sides, bottom and top of the frame is pressure maintain on all of the outwardly facing weather strips in the channels 53 and 54.

Turning now to FIG. 11, there is shown a horizontal cross-section through the double-hung sash window providing the vertical sliding action. The exterior frame is formed by the combination of the common outer profile 10 and the first inner profile 11. These are assembled as previously described so that the channels 42 and 43 provide receptacles for the operating mechanisms 88 and 89 of the vertical sliding sash arrangement. The operating mechanism 88 and 89 are of a conventional nature commercial available from suitable suppliers. These arrangements control the sliding movement of the sliding sash window both in the inside to outside direction holding the windows in place and also in the vertical direction so that the windows remain at a position set manually by the person sliding the window to the required position. Both windows are individually slidable so they can be opened from the top or from the bottom. The sash windows are of the same type as previously described so that the three weather strips in the channels 52, 53 and 54 butt against the respective surfaces of the second inner profile. Thus the weather strip in the channel 52 of the outside sash butts against the flange 48, the weather strip in the channel 53 butts against the flange 47 and the weather strip in the channel 54 butts against the flange 45. Symmetrically the weather strips of the inside sash window butt against a flange 48A and the weather strips 53 and 54 but against the flanges 46 and 35 respectively.

Since various modifications can be made in my invention as herein above described, and many apparently widely different embodiments of same made within the spirit and scope of the Claims without department from such spirit and scope, it is intended that all matter contained in the accompanying specification shall be interpreted as illustrative only and not in a limiting sense.

The invention claimed is:

1. A combination of profiles for forming fenestration constructions comprising:

a common outer profile a first inner profile for co-operation with the outer profile shaped and arranged for forming a double hung sash window;

the first inner profile having an inner section which co-operates with the outer profile in defining a first sash receiving section and a second sash receiving section arranged alongside and to the inside of the first sash receiving section;

the first sash receiving section being arranged to receive in sliding movement therealong an outside one of two sash members and including a first channel outwardly of said outside one of said two sash members arranged to receive and contain operating hardware for the member;

the second sash receiving section being arranged to receive in sliding movement therealong an inside one of said two sash members and including a second channel outwardly of said inside one of said two sash members arranged to receive and contain operating hardware for the member;

a second inner profile for co-operation with the outer profile shaped and arranged so as to be different from the first inner profile and arranged for use, with the first inner profile omitted, in forming a slider construction;

the second inner profile having an inner section which co-operates with the outer profile in defining a first sliding sash receiving section and a second sliding sash receiving section arranged alongside and to the inside of the first sliding sash receiving section;

the first sliding sash receiving section being arranged to receive in sliding movement therealong an outside one of two sliding sash members;

the second sliding sash receiving section being arranged to receive in sliding movement therealong an inside one of the two sliding sash members;

the common outer profile having an outwardly facing surface for engaging an opening in a wall;

the common outer profile defining an inwardly facing receiving channel shaped to receive and locate an outer section of the first inner profile;

the common outer profile defining an inwardly facing receiving channel shaped to receive and locate an outer section of the second inner profile with the first inner profile omitted:

such that the common outer profile can be used alternately with the first inner profile to manufacture double hung sash members and with the second inner profile for manufacturing sliding sash members;

the receiving channel having an inside side wall and an outside side wall spaced by a width of the first and second inner profiles so as to receive the first and second inner profiles therein with an outside wall of the first and second inner profiles in contact with the outside wall of the outer profile and an inside wall of the first and second inner profiles in contact with the inside wall of the outer profile.

2. The combination according to claim 1 wherein the inside side wall of the common outer profile extends at right angles to the outwardly facing surface and the outside side wall of the common outer profile is inclined.

3. The combination according to claim 1 wherein the inside side wall and the outside side wall of the common outer profile each have at side edges of the outwardly facing surface inside and outside slots for receiving inside and outside brick molds.

4. The combination according to claim 1 wherein each of the first and second inner profiles includes co-operating elements thereon for co-operating with elements on the common outer profile for location in the inwardly facing receiving channel of the common outer profile by snap fastening of the cooperating elements.

5. The combination according to claim 4 wherein the co-operating elements of the first inner profile are arranged to allow engagement of the first inner profile in the inwardly facing receiving channel of the common outer profile by longitudinal sliding therein and the co-operating elements of the second inner profile are arranged to allow engagement of the second inner profile in the inwardly facing receiving channel of the common outer profile by longitudinal sliding therein.

6. The combination according to claim 4 wherein the co-operating elements of the first inner profile include recesses receiving shoulders projecting from the inside and outside side walls into engagement with the recesses of the first inner profile and wherein the co-operating elements of the second inner profile include recesses receiving shoulders projecting from the inside and outside side walls into engagement with the recesses of the second inner profile.

7. The combination according to claim 4 wherein the inwardly facing receiving channel of the common outer profile has an inwardly facing outer base wall and the first inner profile includes an outwardly facing outer base wall with a projecting bead therealong for engagement into a co-operating recess in the outer base wall of the common outer profile and the second inner profile includes an outwardly facing outer base wall with a projecting bead therealong for engagement into a co-operating recess in the outer base wall of the common outer profile.

8. The combination according to claim 1 wherein, in a completed slider construction formed by the common outer profile and the second inner profile and two sliding sash members, a top part of the second inner profile is shaped to form a transverse wall which is received in the inwardly facing receiving channel of the common outer profile and is free to slide in the inwardly facing receiving channel in a direction inwardly and outwardly so as to engage a top surface of each of the two sliding sash members of the slider construction.

9. The combination according to claim 8 wherein the second inner profile includes co-operating elements thereon for co-operating with elements on the common outer profile for location in the inwardly facing receiving channel thereof by snap fastening of the co-operating elements.

10. The combination according to claim 9 wherein the co-operating elements of the second inner profile include recesses for receiving shoulders projecting from the inside and outside side walls into engagement with the recesses of the first inner profile.

11. The combination according to claim 10 wherein the inwardly facing receiving channel has an inwardly facing outer base wall and the second inner profile includes an outwardly facing outer base wall with a projecting bead therealong for engagement into a co-operating recess in the outer base wall of the common outer profile.

12. The combination according to claim 8 wherein the outer surface of each of the two sliding sash member includes at least one weather strip carried thereon for engaging the surface of the second inner profile.

13. The combination according to claim 8 wherein the common outer profile includes a wall at right angles to the outer surface of each of the two sliding sash members which carries a weather strip for engaging the inside one of the two sliding sash members and wherein the second inner profile includes a wall at right angles to the outer surface of the two sliding sash member which carries a weather strip for engaging the outside one of the two sliding sash members.

14. The combination according to claim 1 wherein, in a completed slider construction formed by the common outer profile and the second inner profile and two sliding sash members, the second inner profile has at least one inner hole formed therein at a selected position along the length thereof for escape of moisture from an inner part of the second inner profile outwardly to the common outer profile; wherein the common outer profile has an outside facing surface with an outer hole formed therein at a selected position along the length thereof for escape of moisture from the common outer profile; and wherein the position of the at least one inner hole is longitudinally offset from the position of the outer hole to prevent direct penetration of air.

15. The combination according to claim 14 wherein the second inner profile has a sloped surface inclined in the direction toward the outside away from an outer one of the two sliding sash members so as to tend to drain moisture outwardly.

16. The combination according to claim 14 wherein the second inner profile and the common outer profile each have a sloped surface inclined in the direction toward the outside away from an outer one of the two sliding sash members so as to tend to drain moisture outwardly, the sloped surface of the second inner profile and the sloped surface of the common outer profile lying in contact.

17. The combination according to claim 14 wherein the second inner profile has a plurality of walls extending outwardly from an outer one of the two sliding sash members, each of the walls having a drain hole therethrough.

18. The combination according to claim 14 wherein the second inner profile has at least three drain holes therein at spaced positions therealong, with one at each end and at least one intermediate the ends.

19. The combination according to claim 1 further comprising a sash member for mounting in an outer frame formed by the combination of profiles comprising:

a sealed unit defined by a plurality of sheets of glass arranged in parallel coextensive arrangement with spacing strips around the edges thereof and fastening elements around the edges thereof to hold the sheets together and to define four outer peripheral edges of the sealed unit and first and second exposed sheet surfaces of the sealed unit;

four frame members connected at corners of the sash member to form a rectangular frame construction, each frame member being formed from an extruded profile;

each frame member comprising a generally rectangular structural portion having an inwardly facing surface for receiving in contact therewith a respective one of the four outer peripheral edges of the sealed unit, the inwardly facing surface having a width defined between first and second side edges equal to a width of the outer peripheral edge;

each frame member having an integral stop wall at the first side edge extending at right angles to the inwardly facing surface so as to engage the first exposed surface of the sealed unit to contain the sealed unit on the inwardly facing surface;

four separate stop walls each arranged to be fastened to a respective frame member at the second side edge thereof so as to extend at right angles to the inwardly facing surface so as to engage the second exposed surface of the sealed unit to contain the sealed window unit on the inwardly facing surface;

each separate stop wall being connected to its respective frame member by a snap coupling defined by cooperating snap coupling elements on the separate stop wall and the respective frame member which are shaped and arranged such that the separate stop wall is engaged to its respective frame member by movement at right angles to the separate stop wall and parallel to the inwardly facing surface;

a first strip of adhesive sealant material between the first exposed surface and the integral stop wall;

and a second strip of adhesive sealant material between the second exposed surface and the separate stop wall.

20. The combination according to claim 19 wherein the first and second strips preclude the requirement for drainage from the frame.

21. The combination according to claim 19 wherein the coupling elements comprise a lip on the separate stop wall and a recess on the frame member outwardly of inwardly facing surface.

22. The combination according to claim 21 wherein the frame member includes a side wall and an inner support wall parallel to the side wall both arranged at right angles to the inwardly facing surface with the recess on the frame member having an open mouth at the side wall and a base supported by the inner support wall.

23. The combination according to claim 21 wherein the separate stop wall includes a bottom leg substantially parallel to the inwardly facing surface outwardly thereof for extending into the recess on the frame member.

24. The combination according to claim 19 wherein the structural portion has three weather strip channels therein arranged with two in an outer wall parallel to the inwardly facing surface and the third in a side wall at right angles to the inwardly facing surface.

25. The combination according to claim 19 wherein the sealed unit is defined by three sheets of glass arranged in parallel coextensive arrangement with the spacing strips around the edges thereof defining between each sheet and the next a spacing of at least 0.5 inches.

26. A combination of profiles for forming fenestration constructions comprising:

an outer profile;

an inner profile for co-operation with the outer profile shaped and arranged for forming a slider member;

two sliding sash members arranged to slide in a sliding direction;

the inner profile having an inner section which co-operates with the outer profile in defining a first sliding sash receiving section and a second sliding sash receiving section arranged alongside and to the inside of the first sliding sash receiving section;

the first sliding sash receiving section being arranged to receive in sliding movement therealong an outside one of the two sliding sash members;

the second sliding sash receiving section being arranged to receive in sliding movement therealong an inside one of the two sliding sash members;

the outer profile having an outwardly facing surface for engaging an opening in a wall;

the outer profile defining an inwardly facing receiving channel shaped to receive and locate an outer section of the inner profile;

the receiving channel having an inside side wall and an outside side wall spaced by a width of the inner profile so as to receive the inner profile therein with an outside wall of the inner profile in contact with the outside wall of the outer profile and an inside wall of the inner profile in contact with the inside wall of the outer profile;

wherein, in a completed slider construction formed by the outer profile and the inner profile and the two sliding sash members, a top part of the inner profile at the top of the slider construction is shaped to form a transverse wall which is received in the inwardly facing receiving channel of the outer profile and spans between the inside and outside wall of the outer profile so as to engage a top surface of each of the two sliding sash members of the slider construction;

and wherein the transverse wall forming the top part of the inner profile is, when located in the inwardly facing receiving channel, free to move in the inwardly facing receiving channel between the inside and outside walls thereof in an inward and outward direction which is at right angles to the sliding direction to maintain contact with the top surface of the two sliding sash members.

27. The combination according to claim 26 wherein inner profile includes co-operating elements thereon for cooperating with elements on the outer profile for location in the inwardly facing receiving channel of the outer profile by snap fastening of the co-operating elements.

28. The combination according to claim 27 wherein the inwardly facing receiving channel has inside and outside side walls and wherein the co-operating elements of the inner profile include recesses for receiving shoulders projecting from the inside and outside side walls into engagement with the recesses of the inner profile.

29. The combination according to claim 28 wherein the inwardly facing receiving channel has an inwardly facing outer base wall and the inner profile includes an outwardly facing outer base wall with a projecting bead therealong for projecting into a co-operating recess in the outer base wall.

30. The combination according to claim 26 wherein the outer surface of each of the sliding sash members includes at least one weather strip carried thereon for engaging the transverse wall of the top part of the inner profile.

31. The combination according to claim 26 wherein the outer profile includes a wall at right angles to the outer surface of the sash members which carries a weather strip for engaging the inside one of the sash members and wherein the inner profile includes a wall at right angles to the outer surface of the sash members which carries a weather strip for engaging the outside one of the sash members.

32. A combination of profiles for forming fenestration constructions comprising:

an outer profile;

an inner profile for cooperation with the outer profile shaped and arranged for forming a frame;

two sliding sash members arranged to slide in a sliding direction;

the inner profile having an inner section which co-operates with the outer profile in defining a first sash receiving section and a second sash receiving section arranged alongside and to the inside of the first sash receiving section;

the first sash receiving section being arranged to receive in sliding movement therealong an outside one of the two sash members;

the second sash receiving section being arranged to receive in sliding movement therealong an inside one of the two sash members;

the outer profile having an outwardly facing surface for engaging an opening in a wall;

the outer profile defining an inwardly facing receiving channel shaped to receive and locate an outer section of the inner profile;

the receiving channel having an inside side wall and an outside side wall spaced by a width of the inner profile so as to receive the inner profile therein with an outside wall of the inner profile in contact with the outside wall of the outer profile and an inside wall of the inner profile in contact with the inside wall of the outer profile;

wherein the inwardly facing receiving channel of the outer profile has an inwardly facing outer base wall and the inner profile includes an outwardly facing outer base wall;

wherein the inner profile includes at least one dividing wall extending inwardly from the outer base wall and along the inner profile and dividing the inner profile into separate compartments extending along the inner profile;

the inner profile having at least one inner hole formed in the at least one dividing wall at a selected position along the length thereof for communication of moisture from a first of the separate compartments of the inner profile to a second of the separate compartments of the inner profile, which second compartment is located relative to the first in a direction toward the outside side wall of the outer profile such that the moisture moves through the inner hole toward the outside side wall of the outer profile;

the outer profile having an outer hole formed in the outside side wall thereof at a selected position along the length thereof for escape of moisture from the outer profile;

the position of the inner hole of the inner profile being longitudinally offset from the position of the outer hole of the outer profile to prevent direct penetration of air.

33. The combination according to claim 32 wherein the inner profile has a sloped surface inclined in the direction toward the outside away from the sash member so as to tend to drain moisture outwardly.

34. The combination according to claim 32 wherein the inner and outer profiles each have a sloped surface inclined in the direction toward the outside away from the sash member so as to tend to drain moisture outwardly, the surfaces lying in contact.

35. The combination according to claim 32 wherein the inner profile has a plurality of divider walls, each of the divider walls having a drain hole therethrough.

36. The combination according to claim 32 wherein the inner profile has at least three drain holes therein at spaced positions therealong, with one at each end and at least one intermediate the ends.

* * * * *